United States Patent [19]

Hill

[11] 4,037,255

[45] July 19, 1977

[54] IMPLOSION PROTECTION SYSTEM FOR COLOR CRT BULB HAVING A BONDED FUNNEL FRAME

[75] Inventor: Monty B. Hill, Chicago, Ill.

[73] Assignee: Zenith Radio Corporation, Glenview, Ill.

[21] Appl. No.: 639,741

[22] Filed: Dec. 11, 1975

[51] Int. Cl.[2] ..... H01J 29/87

[52] U.S. Cl. ..... 358/246; 220/2.1 A

[58] Field of Search ..... 178/7.8, 7.82; 220/2.1 A, 2.3 A; 313/477

[56] References Cited

U.S. PATENT DOCUMENTS

| | | | |
|---|---|---|---|
| 2,222,197 | 11/1940 | Engels | 313/477 X |
| 3,894,260 | 7/1975 | Sedivy | 313/405 |
| 4,004,092 | 1/1977 | Rogers | 358/246 |

*Primary Examiner*—Howard W. Britton

*Attorney, Agent, or Firm*—John R. Garrett

[57] ABSTRACT

This disclosure depicts a novel funnelbond system for implosion protecting a color television picture tube having a flangeless faceplate and a mating funnel. The funnelbond system is illustrated as comprising, in its most general sense, a high tensile strength frame which surrounds and hugs a portion of the funnel adjacent the faceplate. A cement bonds the frame to the funnel portion. The system binds up the funnel portion to provide implosion protection.

8 Claims, 3 Drawing Figures

IMPLOSION PROTECTION SYSTEM FOR COLOR CRT BULB HAVING A BONDED FUNNEL FRAME

CROSS REFERENCE TO RELATED APPLICATIONS

This application relates to, but is no way dependent upon, copending applications of common ownership herewith, including: Ser. No. 623,854, filed Oct. 20, 1975; and Ser. No. 628,853, filed Oct. 20, 1975.

BACKGROUND OF THE INVENTION

This invention relates in general to color television picture tubes and in particular to a system for implosion protecting such tubes. Conventionally, a color television picture tube has a glass bulb including a funnel, a flanged faceplate sealed to the flared end of the funnel, and an electron gun assembly mounted in the funnel neck for providing a source of cathrode rays. The faceplate has a concave inner surface on which is deposited an electron-excitable phosphor screen. After the faceplate is sealed to the funnel, the glass bulb is evacuated and as a result, several tons of atmospheric pressure is exerted against the external surface of the faceplate. A glass bulb of this type is subject to implosion. The term "implosion" is defined by Underwriters Laboratory Incorporated as "rapid and sudden inward bursting of a high-vacuum glass envelope." It is of the utmost importance in the interest of safety to prevent the faceplate from violently shattering should it be struck for example, by a heavy missile, for when a bulb implodes fragments of glass may fly forwardly from the tube into the viewing area.

Three basic approaches for implosion protecting color cathode ray tubes (CRT's) have evolved. These three approaches employ different principles of operation. One approach is implemented in systems referred to as "rimbond" systems. The rimbond system has a scalloped metal frame which surrounds the flange found on every conventional faceplate. The gap between the frame and the faceplate flange is filled with a cement--typically an epoxy cement. In a rimbond system, the frame is not under tension. The cemented frame holds in position the pieces of glass of a shattered faceplate long enough for air to enter the tube through the cracks formed so that pressure builds up in the tube relatively slowly. This prevents unacceptable amounts of glass from being projected forwardly from the tube although the tube may still collapse. Patents illustrating such rimbond systems are U.S. Pat. Nos. 3,485,407; 3,558,818; 3,412,203, and 3,835,250. A major drawback to such rimbond systems has been the large amounts of very costly epoxy cement needed to adhere the metal frame to the faceplate.

A second basic implosion protection approach is termed the "tension band" approach. Systems implementing this approach comprise a strap or band which is placed around the faceplate flange and put under very high tensile force. Numerous patents have been issued on various aspects of tension band systems. See 3,818,557; 3,777,057, 3,845,530; 3,890,464. The tension band systems, however, also have several drawbacks. When the tension band is tightened about the faceplate flange, it is very likely that the glass will be scratched as the band moves across it during the tightening process. This creates flaws at the location of the scratches, increasing the possibility of cracks forming there during implosion. Also, the distribution of forces applied to the faceplate flange by the band is irregular. Specifically, the forces applied at the corners by the band are much greater than the forces applied at the sides of the faceplate flange. The third approach is to bond a transparent protection shield over the front surface of the faceplate. Systems following this approach are commonly termed "bonded panel" systems. The bonded panel systems have no pertinence to this invention and therefore will be not discussed further.

A U.S. Pat. No. 2,222,197 to Engels discloses a CRT in which the CRT envelope comprises a curved flangeless faceplate inset in an expanded open end of a cooperating funnel. A band allegedly providing implosion protection surrounds the funnel near the open end thereof in a plane intersecting the faceplate ensconsed within the funnel mouth. The Engels system is quite different from the present system. No frame of any sort is provided. The implosion band environs the funnel rather than the faceplate peripheral edge. A comparison of the Engels system and the present system will reveal other important differences, also.

This invention is believed to be most useful when applied to a tube having a flangeless faceplate such as is disclosed in U.S. Pat. No. 3,894,260, issued to the assignee of this application. The tube has a flangeless, curved glass faceplate, a concave inner surface of which receives a phosphor screen. The funnel portion of this unique tube has a convex seal land which matches and mates with the curvature of the concave inner surface of the faceplate.

OBJECTS OF THE INVENTION

It is a general object of the present invention to provide for a color television picture tube an improved system for implosion protection.

It is a more specific object of the present invention to provide an effective and low cost implosion protection system for a novel color television picture tube having a flangeless faceplate.

DESCRIPTION OF THE PREFERRED EMBODIMENT

Figure 2:
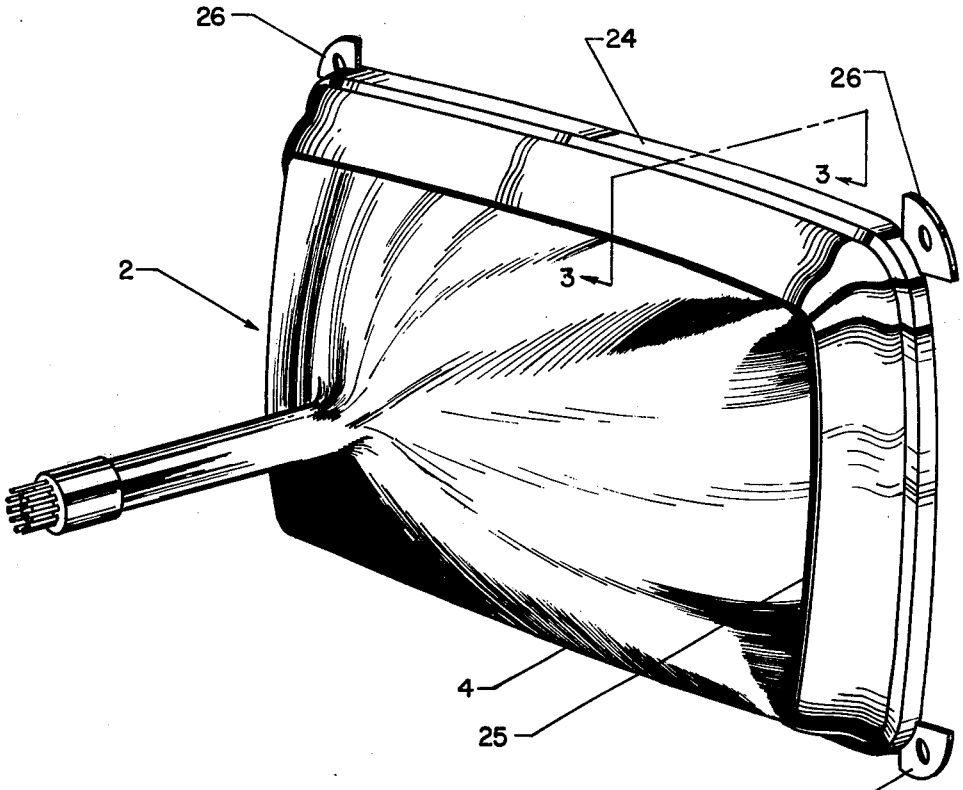
FIG. 2 is a rear perspective view of a color television picture tube representing a preferred embodiment of the present invention.
Figure 1:
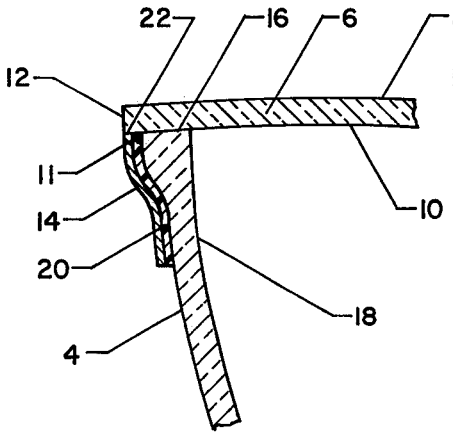
FIG. 1 is an enlarged schematic fragmentary side section view of a color television picture tube representing one embodiment of the teachings of this invention wherein the front edge of a novel implosion frame confronts the rear surface of the tube's flangeless faceplate.
Figure 3:
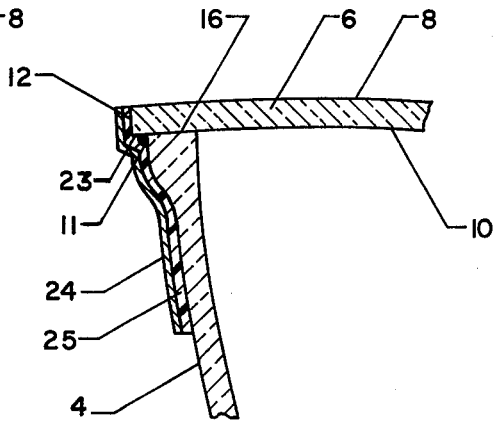
FIG. 3 is an enlarged schematic fragmentary side section view of the FIG. 2 tube, taken along lines 3—3 in FIG. 2.

Whereas the invention may be implemented in color television picture tubes of various types, it is preferably embodied in a tube of the nature shown in FIGS. 1–3. The tube 2, has an envelope or bulb comprising a funnel 4 sealed to a flangeless faceplate 6. The unique construction of the faceplate 6 without a flange permits economies in manufacture of the envelope and simplified and economical screening and assembly processes. The faceplate 6 has a curved configuration which may be spherical, multi-radial, cylindrical, or of other suitable curvature. The faceplate 6 has a convex front surface 8 connected to a concave rear surface 10 by a peripheral edge surface 12. The edge surface 12 is contoured, that is, the edge surface portions along sides of the faceplate depart from and return to a plane connecting the four corners of the faceplate.

The funnel 4 has a convex seal land, herein intended to mean a seal land which lies on an imaginary curved surface, which surface curvature may be spherical, multiradial, cylindrical, or of other suitable curved configuration. The seal land of the funnel 4 is curved to match and mate with the concave rear surface 10 of the faceplate 6 along a sealing interface 16. The seal land of the funnel 4 is hermetically bonded to the rear surface 10 of the faceplate 6 by a devitrifying glass solder herein termed a "frit material" 11.

The concave rear surface 10 of the faceplate 6 is here shown as being slightly larger than the wide end of the funnel 4 to which the faceplate 6 is attached. Thus, when the tube 2 is assembled, the faceplate has a marginal portion which overhangs the funnel slightly. Alternatively, the faceplate edge surface 12 may be flush with the outside surface of the funnel 4.

The present invention will now be described. As described, relevant prior art systems used on conventional flanged faceplate tubes followed either of two approaches; 1) the "rimbond" approach wherein a portion of the outside surface of the faceplate flange is cemented to a surrounding variable depth frame; and 2) the "tension band" approach wherein the flange is compressed tightly by a high tension band. This invention involves a unique approach to implosion protection, that is, a funnelbond implosion protection system for a color television picture tube in which a portion of the funnel adjacent the faceplate is bound up and held by a cemented frame. A novel funnelbond implosion protection system constructed according to this invention is illustrated in FIG. 1. As will be explained hereinafter, the FIGS. 2–3 embodiment is preferred by reason of the greater implosion protection afforded (although its cost is slightly higher). However, because the FIG. 1 embodiment more clearly expounds the funnelbond implosion protection system lying at the heart of this invention, it will be described first.

In accordance with the teachings of this invention, the implosion protection system of this invention includes as a critical part thereof a high tensile strength frame 14. The frame 14 is structured to surround and hug a portion 18 of the funnel adjacent to the faceplate 6. Reiterating, the metal frame 14 has a contour which corresponds substantially to the contour of the funnel portion 18; that is, the spacing between the funnel portion 18 and the frame 14 is fairly constant over the funnel portion 18. A cement 20 is provided to bond the frame 14 to the funnel portion 18. By contouring the frame 14 to the funnel portion 18, the amount of cement 20 needed is reduced. The cement 20 is preferably an epoxy type which not only is an extremely effective bonding agent, but is electrically insulative. As will become evident, the use of an electrically insulative cement obviates the customary operation of wrapping the sealing interface between the funnel and the faceplate with insulative tape to electrically insulate the sealing interface.

The frame 14 may have a planar rear edge (lying in a plane) or the rear edge may be contoured so as to have a substantially constant depth. If the frame is contoured, the amount of frame material and cement needed is reduced, but certain undesirable drawbacks occur. Specifically, a thixotropic type of epoxy must be used. This type of epoxy is difficult and expensive to introduce between the funnel 4 and the frame 14. Therefore, it is believed that the use of a frame having a planar rear edge is more advantageous in that a liquid epoxy of low viscosity can be used. With the tube 2 in a face-down position, the epoxy can be simply poured into the space between the frame 14 and the funnel portion 18. The tube 2 is left in this position until the epoxy has solidified. Thus the frame fillability of this latter described embodiment of the present invention provides for economies and ease in manufacturing.

In the embodiment of the invention illustrated in FIG. 1, the front edge of the frame 14 is contoured and the frame sized so that the front edge contacts the marginal rear portion 22 of the faceplate 6. This allows for ease in positioning frame 14 relative to the funnel 4 and assists in sealing the frame to the funnel to facilitate introduction of the cement 20 between the frame and funnel.

The funnel frame 14 covers, in addition to the funnel portion 18, the sealing interface 16 and the contained frit material 11. Therefore, when the cement 20 is introduced between the funnel 4 and the frame 14 it will cover the sealing interface 16. It is desirable for the cement 20 to cover the sealing interface 16 for two reasons. First, the implosion protection afforded by the system is improved. Second, the epoxy cement, being a good electrical insulator, insulates the sealing interface and obviates the customary wrapping of the sealing interface with insulative tape.

The preferred FIGS. 2–3 embodiment will now be described. In this embodiment a frame 24 is provided which, like frame 14 in the FIG. 1 embodiment, surrounds and hugs a portion of the funnel adjacent the faceplate. However, the FIGS. 2–3 frame 24 also has a forward portion 23 which is offset radially outwardly and hugs the peripheral edge suface 12. A cement 25 is employed to bind the frame 24 to the bulb. For reasons described above, the rear edge of the frame 24 preferably lies in a plane and a non-viscous type A epoxy cement is preferably used. In accordance with this embodiment of the invention, the frame 24 and frame-contained cement 25 embrace and bind up the entire edge surface 12 of the faceplate 6 as well as the portion 18 of the funnel 4 adjacent the faceplate. As taught by the referent copending application Ser. No. 628,853, effective implosion protection can be provided solely by the provision of an edgebound shallow frame system which binds up only the edge surface 12 of the faceplate. The FIGS. 2–3 embodiment combines the implosion protection afforded by the novel funnelbond system of this invention and that afforded by the edgebond system.

Since the funnelbond structure according to this embodiment of the invention embraces and binds up the actual thickness dimension of the faceplate 6, as well as the funnel portion 18, the FIGS. 2–3 embodiment provides significantly greater implosion protection than the FIG. 1 embodiment. This provides a tube manufacture with certain options. A tube can be built with a very high degree of implosion protection, or, for reasons of cost economy, a tube with reduced but adequate implosion protection can be built having a shallower, less costly frame. In other words, for a given degree of implosion protection afforded, a deeper frame is needed for the FIG. 1 embodiment than for the FIGS. 2–3 embodiment.

As illustrated in FIG. 2, mounting tabs 26 for attaching the tube 2 to a cabinet may be included as part of the frame 24. In the preferred embodiment the tabs 26 extend from the corners of the frame 24 and have provisions, such as holes, for permitting attachment of the tube 2 to the cabinet. Alternatively these tabs could be placed anywhere about the frame or formed in a way which would best suit the type of cabinet being used.

Underwriters Laboratories Incorporated ("UL") sets the standards for implosion-protected cathode ray tubes for television receiving equipment. The test employed by UL is generally as follows: The color television picture tube is mounted in a test cabinet enclosure of a specified size (depends on the size of the tube). The cabinet is supported on a 30 inch high, rigid, table-like test stand. Two barriers each ½ inch thick, 9½ inches high and 72 inches long are placed on edge on the floor in front of the test stand. The barriers are located at distances of 3 ft. and 5 ft., respectively, from the plane of the front enclosure of the cabinet. The three areas bounded by the barriers are indicated as follows: Zone 1: 0–3 ft., Zone 2: 3–5 ft., Zone 3: 5 ft. and beyond. The ball impact test is defined as follows: An impact is to be applied to any point on the face of the tube 1½ inches away from the edge of the screen area and is to be obtained from a solid, smooth, steel sphere 2 inches in diameter and weighing apprroximately 1.18 lbs. The sphere is to be suspended by a suitable cord and allowed to fall freely as a pendulum from rest through a distance necessary to cause it to strike with an impact of 5 foot-pounds. The cabinet supporting the cathode ray tube is to be placed so that the surface tested is vertical and in the same vertical plane as the point of support of the pendulum. When a tube is tested as described above, the amount of glass thrown forward shall not exceed the following. First there shall be no single piece of glass weighing more than ½ oz. in Zone 2; second, the total weight of all the pieces of glass in Zone 2 shall not exceed 1½ oz.; and third, there shall be no single piece of glass in Zone 3 weighing more than 0.05 oz.

One embodiment (for a 19 inch diagonal tube) of the invention similar to that shown in FIGS. 2–3 has been constructed. From preliminary test results, it is expected that the tube will successively pass the implosion protection tests of the Underwriters Laboratory Incorporated (described above). This embodiment comprised a cold-rolled steel frame with a thickness in the range 0.025 to 0.030 inch and with a corner depth (front-to-back) of approximately 1¼inches. The frame 24 covered the edge surface 12 of the faceplate 6 as well as the funnel portion 18. (It is believed that to ensure adequate implosion protection when using a frame which does not cover the edge surface 12, as shown in FIG. 1, the corner depth should be at least 2 inches.) The gap between the frame 24 and the edge surface 12 of the faceplate 6 and between the frame 24 and the funnel portion 18 was in the range 0.090 inch to 0.100 inch. A liquid type A epoxy was introduced into the gap so as to cover the edge surface 12, the sealing interface 16 and the portion 18 of the funnel 4. A strip of masking tape was used temporarily to seal the frame 24 and the front surface 8 of the faceplate 6 until the epoxy cement 20 hardened.

The invention is not limited to the particular details of construction of the device depicted and other modifications and applications are contemplated. For example, whereas the above-depicted embodiment included an approximately spherical or multi-radial faceplate, the invention may be applied to other types of tubes having a contoured faceplate edge surface and sealing interface-- e.g., a tube having a flangeless cylindrical faceplate. The trade-off of implosion protection versus cost can be varied by varying the strength of the frame (its thickness, depth, frame material, etc.) and the depth of the funnel overlaid—the greater the frame strength and funnel overlay, the greater the implosion protection provided. Certain other changes may be made in the above-described device without departing from the true spirit and scope of the invention herein involved. It is intended therefore that the subject matter in the above depiction shall be interpreted as illustrative and not in a limiting sense.

What is claimed:

1. A color television picture tube having a glass bulb with an approximately rectangular, flangeless, curved faceplate having a convex front surface through which television pictures are viewed, a concave rear surface with a phosphor screen deposited on a portion thereof, the glass bulb also having a funnel having a convex seal land which mates with the concave inner surface of the faceplate to define a contoured sealing interface, said tube including a low cost funnelbond implosion protection system comprising:

a high tensile strength frame which surrounds and hugs a portion of said funnel adjacent to said faceplate; and a cement between said frame and said funnel, said cement and said frame binding up said funnel portion to provide implosion protection.

2. The combination defined by claim 1 wherein said faceplate has a marginal portion which overhangs said funnel and wherein a front edge of said frame contacts said rear surface of said marginal portion of said faceplate for positioning said frame relative to said funnel.

3. A color television picture tube having a glass bulb with an approximately rectangular, flangeless, curved faceplate having a convex front surface through which television pictures are viewed, a concave rear surface with a phosphor screen deposited on a portion thereof, the glass bulb also having a funnel having a convex seal land which mates with the concave inner surface of the faceplate to define a contoured sealing interface, said tube including a low cost funnelbond implosion protection system comprising:

a scalloped, metal high tensile strength frame which surrounds and hugs a portion of said funnel adjacent to said faceplate and which covers said sealing interface; and an electrically insulative epoxy-type cement between said frame and said funnel which with said frame embraces and binds up said sealing interface and said portion of said funnel, said cement also serving to electrically insulate said sealing interface.

4. The combination defined by claim 3 wherein said faceplate has a marginal portion which overhangs said funnel and wherein a front edge of said frame contacts said-rear surface of said marginal portion of said faceplate for positioning said frame relative to said funnel.

5. A color television picture tube having a glass bulb with an approximately rectangular, flangeless, curved faceplate having a convex front surface through which television pictures are viewed, a concave rear surface with a phosphor screen deposited on a portion thereof, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said tube including a low cost funnelbond implosion protection system comprising:

a high tensile strength frame which surrounds and hugs a portion of said funnel adjacent to said faceplate and which surrounds and hugs said edge surface of said faceplate; and a cement between said frame and said bulb, said cement and said frame binding up said portion of said funnel and said edge surface of said faceplate.

6. The combination defined by claim 5 wherein said frame substantially covers the entire area of said edge surface without extending beyond said front surface of said faceplate.

7. A color television picture tube having a glass bulb with an approximately rectangular, flangeless, curved faceplate having a convex front surface through which television pictures are viewed, a concave rear surface with a phosphor screen deposited on a portion thereof, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said faceplate having a marginal portion which overhangs said funnel, said tube including a low cost funnelbond implosion protection system comprising:

a scalloped, metal high tensile strength frame which surrounds and hugs a portion of said funnel adjacent to said faceplate, said frame having a forward portion which is offset radially outwardly to surround and hug said edge surface of said faceplate and said marginal portion of said faceplate which overhangs said funnel, the contour of said frame corresponding substantially to the contour of said edge surface and said funnel portion and covering said sealing interface; and an electrically insulative epoxy-type cement between said frame and said bulb which with said frame embraces and binds up said portion of said funnel, said edge surface of said faceplate, and said sealing interface, said cement also serving to electrically insulate said sealing interface.

8. The combination defined by claim 7 wherein said frame substantially covers the entire area of said edge surface without extending beyond said front surface of said faceplate.

* * * * *